US007261037B2

(12) United States Patent
Joseph, Jr.

(10) Patent No.: US 7,261,037 B2
(45) Date of Patent: Aug. 28, 2007

(54) PYROTECHNIC ANIMAL DISPERSAL DEVICE

(76) Inventor: J. Barthell Joseph, Jr., 1079 Cedar St., Greenville, MS (US) 38702

( * ) Notice: Subject to any disclaimer, the term of this patent is extended or adjusted under 35 U.S.C. 154(b) by 390 days.

(21) Appl. No.: 10/927,397

(22) Filed: Aug. 27, 2004

(65) Prior Publication Data

US 2006/0042496 A1 Mar. 2, 2006

(51) Int. Cl.
*F42B 4/08* (2006.01)

(52) U.S. Cl. ..... 102/347; 102/346; 102/352; 102/358; 42/1.15

(58) Field of Classification Search ..... 102/346–351, 102/356–358, 502; 124/26–29; 42/1.08, 42/1.12, 1.13, 1.15
See application file for complete search history.

(56) References Cited

U.S. PATENT DOCUMENTS

| | | | | |
|---|---|---|---|---|
| 1,845,381 | A * | 2/1932 | Wiley | 102/358 |
| 2,006,271 | A | 6/1935 | Hitt | |
| 2,247,111 | A * | 6/1941 | Batchelor et al. | 102/501 |
| 2,821,922 | A | 2/1958 | Brown et al. | |
| 3,793,955 | A | 2/1974 | Klecak | |
| 3,913,482 | A | 10/1975 | Schiessl et al. | |
| 4,457,233 | A * | 7/1984 | Hyde | 102/346 |
| 4,917,015 | A | 4/1990 | Lowery | |
| 6,257,146 | B1 | 7/2001 | Stonebraker | |
| 6,263,797 | B1 | 7/2001 | Brice | |
| 6,289,815 | B1 | 9/2001 | Tougeron et al. | |
| 6,412,418 | B1 * | 7/2002 | Shelton | 102/349 |
| 6,508,178 | B2 | 1/2003 | Shelton | |
| 6,779,459 | B2 * | 8/2004 | Werner | 102/349 |
| 7,025,001 | B2 * | 4/2006 | Brunn | 102/502 |
| 2002/0121214 | A1 | 9/2002 | Ledys et al. | |
| 2003/0230211 | A1 * | 12/2003 | Shelton | 102/358 |

FOREIGN PATENT DOCUMENTS

| | | |
|---|---|---|
| EP | 461439 | 12/1991 |
| GB | 2181822 | 4/1987 |

OTHER PUBLICATIONS

Reed-Joseph International Company Brochure (Undated), Sheet Illustrating "Screamer Siren" and "Bird Banger" Cartridges and Launchers.

* cited by examiner

*Primary Examiner*—David Parsley
(74) *Attorney, Agent, or Firm*—Richard C. Litman

(57) ABSTRACT

The pyrotechnic animal dispersal device includes an aerodynamic stabilizer for attachment to a pyrotechnic rocket cartridge and a connector sleeve for joining an explosive cartridge to the rocket cartridge. The connector sleeve has an annular disc disposed therein so that slow burning fuel from the rocket cartridge can pass through the disc and detonate the explosive cartridge when the rocket cartridge nears the end of its flight, thereby extending the range of the explosive cartridge. The cartridges are of the pyrotechnic variety launched from a handheld launcher.

12 Claims, 4 Drawing Sheets

PYROTECHNIC ANIMAL DISPERSAL DEVICE

BACKGROUND OF THE INVENTION

1. Field of the Invention

The present invention relates generally to devices and systems for controlling the location and movement of wild birds and other wild animals. More specifically, the present invention relates to pyrotechnic devices for dispersing animals.

2. Description of the Related Art

The interference of animals with human activities is a chronic problem. Wild animals, such as birds and deer, are a major problem with agriculture, and devices such as scarecrows, wind blown reflective devices, etc. have been used for decades in attempts to frighten away animals and protect crops from animals. While fences are of some value in protecting fields from large herbivores, such as deer, the cost of a fence sufficiently high and tight as to keep out all animals which are attracted to crops, e.g., deer, rabbits, various rodents, etc., would be prohibitive.

Much the same problem occurs at airports, as well. Virtually all airports have relatively wide expanses of open land between and around runways, and many times this land is cultivated to provide some additional income for the airport authority. Land animals are attracted to such crops as alfalfa, timothy hay, and other such crops which are often grown on airport land. Moreover, birds are also attracted to such crops, and many species of birds find relatively low lying plants to be ideal nesting grounds, even if not cultivated for later harvest.

The incursion of such animals on airport property has resulted in a number of tragic accidents in the past. In some instances, aircraft taking off or landing have hit deer, moose, or other large animals while on the runway. In other instances, departing or landing aircraft have hit birds which have broken through windshields and incapacitated one or more members of the flight crew, or have caused the failure of one or more engines.

As a result, it has been recognized for some time that some means of keeping animals away from such areas can be critical, and in fact may be a matter of life and death for air traffic. While sufficiently high fences may assist in keeping larger land animals off of airport property, birds are another matter. In response, pyrotechnic devices have been employed in many areas in attempts to frighten birds and other animals away by means of the loud reports or other sounds produced. Various pyrotechnic devices have been developed and employed, with by far the most predominant of such devices being a relatively simple explosive charge, often automated for remote operation.

The problem with such automated explosive charges is that birds and other animals soon learn that such devices are quite regular in their operation, and have fixed locations. The birds and other animals either congregate elsewhere on the property, or learn to live with the noise. Conventional firearms have also been used, but such devices are not suited for many areas due to the range of the projectiles (bullets) fired therefrom. In any event, the encroachment of a human with a firearm is certain to temporarily frighten away any birds and animals in the area, even before the weapon is fired. The loud report produced by the firearm is of little additional value in frightening birds and other animals away.

One attempt to provide a further solution to this problem has been the development of explosive cartridges which are launched from a special launching gun, and which emit a loud report after traveling a relatively short distance (e.g., thirty to fifty yards). One problem with such devices is that the explosive noise they produce is not particularly far from the human operator, and the human presence has likely frightened away any birds and/or other animals in the immediate vicinity anyway.

Other devices have been developed which produce a somewhat prolonged shrieking noise, or similar prolonged sound. When associated with a small rocket cartridge, the device may travel for a distance of up to one hundred yards or so, emitting a shrieking sound while in flight to frighten away animals. However, once the propellant has been expended, no further noise is produced, and the device falls harmlessly to the ground. The average sound produced is thus only on the order of about fifty yards or so from the person launching the device, and does little to frighten animals at a greater distance.

Accordingly, a need exists for producing an explosive sound at some greater distance from the human operator of the pyrotechnic device, in order to frighten away animals at a greater range. Also, some means of combining the continuous shriek of a rocket cartridge device with the sudden report of an explosive device is also desirable. The present invention provides a solution to this problem by combining a sound emitting rocket cartridge with an explosive device as a two-stage assembly. A specialized sleeve connecting the two cartridges and various means for stabilizing the assembly are also provided. The rocket cartridge with its forwardly attached explosive cartridge is launched using a conventional handheld launcher, using a small caliber blank cartridge for ignition of the rocket. The rocket cartridge travels for a distance on the order of one hundred yards or so while emitting a screaming or shrieking sound, with its range being extended somewhat due to the aerodynamic stabilizing means provided for the assembly. As the rocket cartridge burns out, it ignites the explosive charge to produce a sudden loud report at some distance from the original launch, to frighten away birds and/or other animals at some distance from the launch site.

A discussion of the related art of which the present inventor is aware, and its differences and distinctions from the present invention, is provided below.

U.S. Pat. No. 2,006,271 issued on Jun. 25, 1935 to Ray C. Hitt, titled "Pyrotechnic Display," describes a handheld fireworks device, somewhat like the conventional sparkler but having the combustible material enclosed within a tube which burns down, rather than having the combustible material coating the exterior of a wire. No statement appears in the disclosure that the device emits any sound, and no launching means is provided for propelling the device away from the user.

U.S. Pat. No. 2,821,922 issued on Feb. 4, 1958 to Lawrence W. Brown et al., titled "Rocket Toy And Launcher Therefor," describes a two-stage device comprising a small rocket cartridge with a smaller diameter explosive charge installed in the nose thereof. The Brown et al. device requires a special launcher which is driven into the ground and includes a lateral opening to clear the laterally disposed fuse in the rocket cartridge. The base of the rocket cartridge first stage includes a series of helically disposed exhaust passages, one of which has a fuse passing therethrough. The relatively tall launcher is required to guide the device initially due to the exhaust initially exiting the single exhaust passage where the fuse was placed, thereby resulting in asymmetric thrust until the propellant burns sufficiently to pass through all of the exhaust passages.

U.S. Pat. No. 3,793,955 issued on Feb. 26, 1974 to George Klecak, titled "Buzzing Pyrotechnic Device And Method," describes a single stage, fuse ignited rocket cartridge having a choked exhaust nozzle which results in the device producing a buzzing sound as the propellant burns. No launcher is disclosed, and no explosive second stage is provided. The disclosure states that the device primarily moves and spins around on the ground, as no aerodynamic stabilizing means or launching means are provided to propel it into the air. As such, the device would not be particularly useful for dispersing birds and other animals due to its relatively short range, particularly where vegetation exists to impede its ground movement. The active combustion of the propellant on the surface would also create a fire hazard to any adjacent vegetation, whereas the present invention burns out in the air and cools substantially before reaching the ground as small paper fragments.

U.S. Pat. No. 3,913,482 issued on Oct. 21, 1975 to Alois Schiessl et al., titled "Manually-Operated Projectile-Launching Devices," describes a two-stage projectile for launching from a relatively large caliber firearm, e.g., a Very pistol or the like for launching signal flares. Two propulsion stages are used in order to reduce the "kick" of the firearm during the launching of a relatively heavy projectile. The first stage force is less than that developed by the second stage, and both burn completely within the firing chamber and barrel of the launch gun before leaving the barrel. No sound emission is noted for the projectile in flight, nor is any aerodynamic stabilizing means or explosion at the end of the flight of a rocket cartridge described by Schiessl et al.

U.S. Pat. No. 4,917,015 issued on Apr. 17, 1990 to Charles S. Lowery, titled "Fireworks Rocket Launch Pad," describes a launch tube attached to a baseboard by a relatively soft wire. The wire may be bent as desired to adjust the angle of the launch tube. The baseboard is placed upon the surface; it is not adapted for handheld use. No multiple stage rocket, or rocket which emits a sound during the propellant burn, is disclosed by Lowery.

U.S. Pat. No. 6,257,146 issued on Jul. 10, 2001 to Christopher P. Stonebraker, titled "Noise Making Projectile," describes a shotgun shell having a rocket-propelled cartridge portion with a forwardly disposed explosive portion. The Stonebraker device is relatively costly, as it is configured to be fired from a conventional shotgun. The Stonebraker device relies upon the relatively greater mass of the forward portion of the assembly to provide stability in flight.

U.S. Pat. No. 6,263,797 issued on Jul. 24, 2001 to William F. Brice, titled "Enhanced Flare Apparatus," describes another flare shell configured for firing from a conventional center fire, smooth bore firearm, e.g., shotgun. The Brice shell is a relatively long and deep shell with a relatively weak explosive charge in its base.

U.S. Pat. No. 6,289,815 issued on Sep. 18, 2001 to Raymond Tougeron et al., titled "Device For Controlling Bird Strike Hazards," describes yet another shotgun launched projectile, with the Tougeron et al. projectile having an explosive launch. The Tougeron et al. device includes a delay fuse which is ignited upon firing the device, and which later ignites a forwardly disposed explosive charge after the missile has traveled some distance from the firearm.

U.S. Patent Publication No. 2002/121,214 published on Sep. 5, 2002 to Francis Ledys et al., titled "Avanlanche (sic) Triggering Projectile," describes a shell configured for firing from a relatively large bore launch tube, e.g., a highly pressurized pneumatic launcher or the like. The shell includes an explosive charge at its forward end which is triggered by a time delay from the burning of a charge within the shell after launch and from impact.

U.S. Pat. No. 6,508,178 issued on Jan. 21, 2003 to Gregory P. Shelton, titled "Aerial Fireworks Product Having Synthetic Resinous Stabilizing Base," describes a fireworks shell and stabilizing attachment, which assembly is configured for placement in and launching from a launch tube affixed to a base plate; no means of hand launching the device is described. The stabilizing base comprises a series of parallel longerons spaced apart by interconnecting lateral frame members. The lateral frame members preclude insertion of the shell within the barrel of a launcher with the longerons disposed outside the barrel.

British Patent No. 2,181,822, published on Apr. 29, 1987, titled "Firework Launcher," describes a launching base comprising a stake which is driven into the ground; no hand launching is provided. The base includes a series of radially disposed slots for holding the outboard tips of the stabilizing fins of the fireworks shell therein before and during the launch.

European Patent 461,439, published on Dec. 18, 1991, titled "Pack And Launcher For Pyrotechnic Grenades," describes a multiple launch device incorporating electrical ignition for selectively launching one or more of a series of pyrotechnic grenades. The configuration of the grenades is not disclosed. The launcher is not a handheld device, but must be placed upon a surface and activated remotely.

Finally, an undated brochure from the Reed-Joseph International Company of Greenville, Miss. describes various devices which may be used in combination with the present invention. One of the devices is the "Screamer Siren" cartridge, which has a rocket propellant therein and produces a "siren-like sound" as it travels through the air as the propellant burns. Another device is the "Bird Banger" cartridge, which is a small explosive device. The "Screamer Siren" and "Bird Banger" cartridges are launched individually using either the single shot or double shot launcher illustrated in the brochure. The "Screamer Siren" and "Bird Banger" cartridges, as well as the single and double shot launchers, are all manufactured, in Germany and sold in the U.S. by the Reed-Joseph International Company.

None of the above inventions and patents, taken either singly or in combination, is seen to describe the instant invention as claimed. Thus a pyrotechnic animal dispersal device solving the aforementioned problems is desired.

SUMMARY OF THE INVENTION

The pyrotechnic animal dispersal device comprises various embodiments of a multiple stage, hand launched pyrotechnic device for frightening away and dispersing birds and other animals from an area. The present invention is particularly useful in dispersing animals from croplands, airports; and other open areas where animals often congregate to feed and which may cause significant economical and/or physical damage by their presence and actions. Various embodiments of the device comprise the combination of a small rocket cartridge which is launched from a handheld launcher and which emits a shriek or scream as the propellant is burned as it travels through the air, and a secondary explosive cartridge attached to the front of the rocket cartridge. The two cartridges are conventionally configured to be fired separately from the launcher. The present device includes a connector sleeve securing the two cartridges to one another and providing for the ignition of the secondary explosive cartridge as the primary cartridge is expended.

The device further includes various aerodynamic stabilizing means for the assembly, to prevent the elongate assembly from tumbling after launch, thereby extending the range of the explosive device.

The combination of the two separate cartridges into a single unit, permits the first rocket cartridge to propel the second explosive cartridge a greater distance from the launch than is otherwise possible by launching only the explosive cartridge. The rocket cartridge also emits a loud, piercing, noise which assists in frightening and dispersing animals from the area and propels the explosive charge well away from the launch site and closer to the animals to be dispersed, thereby producing a louder noise in the vicinity of the animals for greater effect.

Various embodiments of the device may include a stabilized rocket cartridge joined to a conventional exploding cartridge without the screaming cartridge, if desired, in order to simply extend the range of the exploding cartridge.

These and other features of the present invention will become readily apparent upon consideration of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present pyrotechnic animal dispersal device relates to adding a booster to a conventional explosive pyrotechnic device to extend the range of the explosive device. The booster may be provided by joining a conventional rocket cartridge to the explosive cartridge, together with a stabilizer for providing stable flight for the combined cartridges and a connector sleeve which conveys the last of the slow burning rocket propellant to the explosive cartridge for exploding the explosive charge after the rocket cartridge has expended the bulk of its fuel. The rocket cartridge may be a sound emitting rocket device. In this combination the device includes a connector sleeve for linking the two cartridges, as well as an aerodynamic stabilizer to stabilize the two-stage assembly and enable it to achieve greater flight distances.

Figure 1:
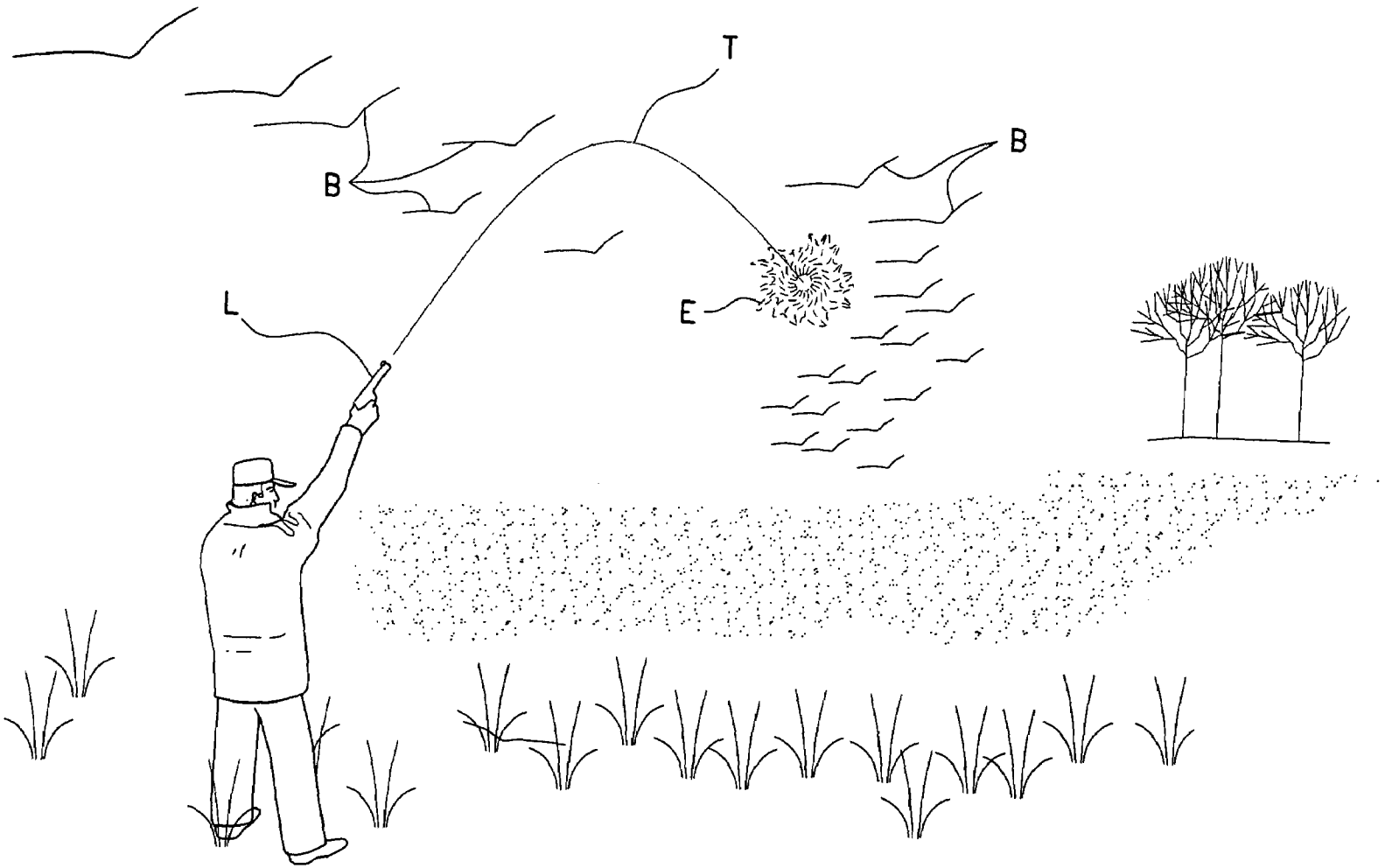
FIG. 1 is an environmental, perspective view showing the operation and use of the pyrotechnic animal dispersal device according to the present invention.
Figure 2:
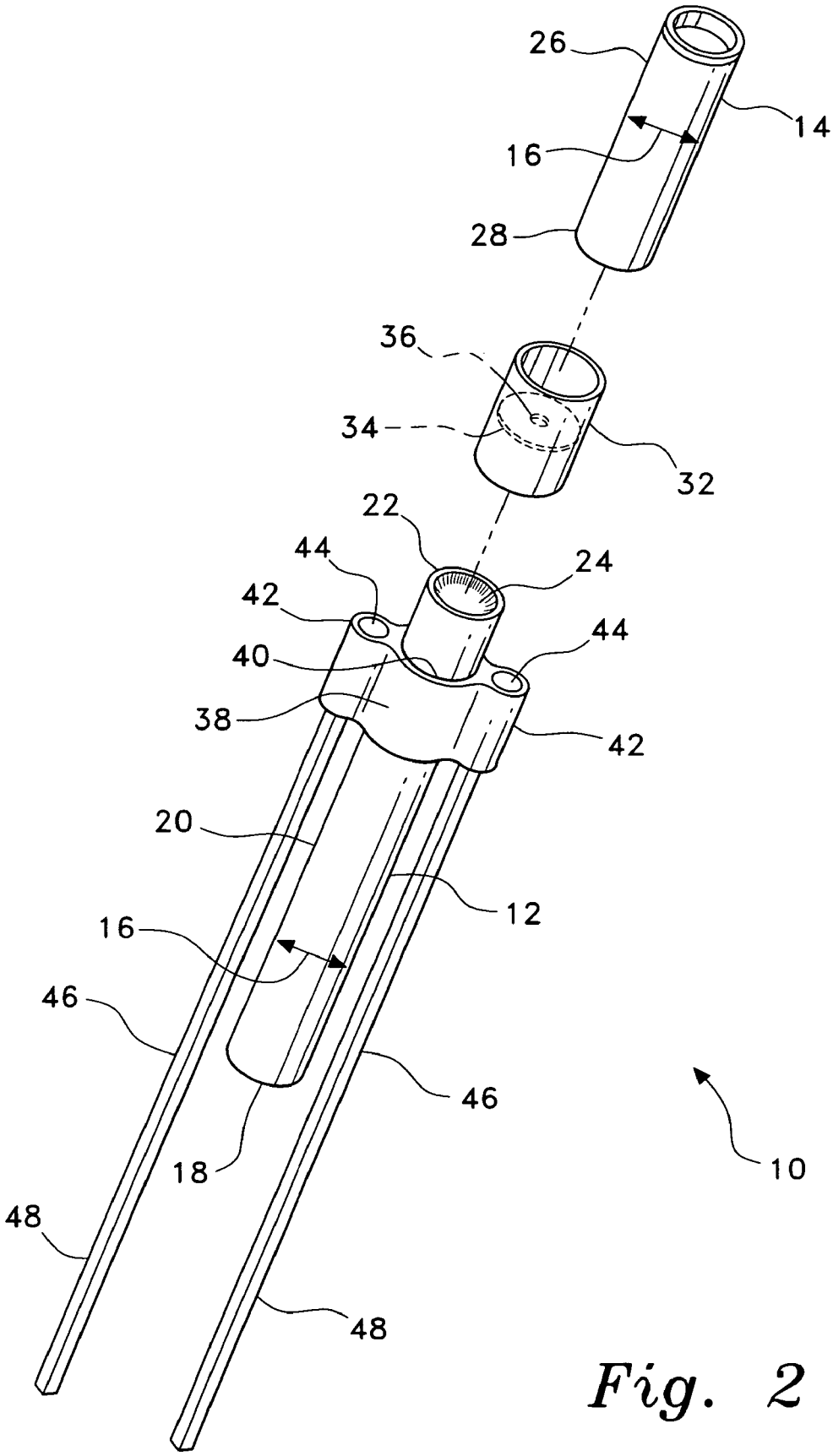
FIG. 2 is an exploded perspective view of an embodiment of a pyrotechnic animal dispersal device according to the present invention, showing details thereof.
Figure 3:
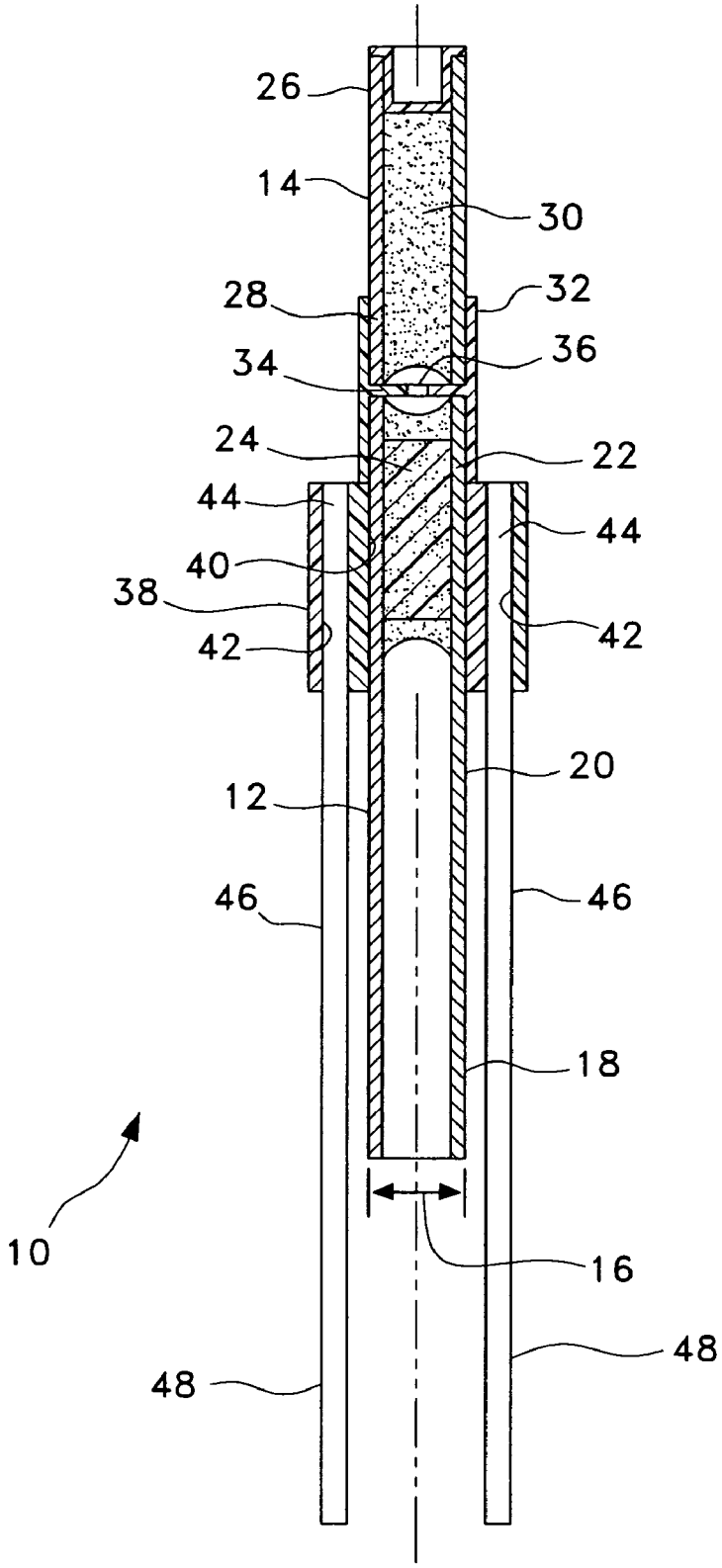
FIG. 3 is a side elevation view in section of the assembled device of FIG. 2, showing various internal details thereof.

FIG. 1 of the drawings provides an environmental perspective view of the launch and operation of an embodiment of the present pyrotechnic device, with FIGS. 2 and 3 providing detailed illustrations of the apparatus itself. The present pyrotechnic device is launched using a handheld launcher L, such as the handheld pistol type launcher L shown in FIG. 1. Such launchers L are readily available for use in launching various small caliber pyrotechnic devices for dispersing birds and other animals. An example of such a launcher L is the single shot RJ-1 distributed by the Reed-Joseph International Co. of Greenville, Miss. The Reed-Joseph International Co. distributes a double shot handheld launcher as well, and these and comparable launchers are available from other sources as well. Each of these launchers utilize a small, 22 caliber (slightly less than 6 mm) short blank cartridge to provide the initial ignition of the pyrotechnic device, once it has been loaded into the muzzle of the launcher L.

The loaded launcher L is aimed somewhat upwardly in the direction desired, the single action hammer is drawn back, and the trigger pulled to percussively fire the blank cartridge. This in turn ignites the rocket cartridge, which is propelled downrange along a ballistic trajectory T. The burning of the propellant in the cartridge also results in a screaming or shrieking sound being produced, as well as propelling the cartridge downrange along the trajectory T as indicated in FIG. 1.

When the charge is expended in the rocket cartridge, the forwardmost portion of the propellant ignites the charge in the explosive cartridge and produces an explosion E at the end of the trajectory T, generally as shown in FIG. 1, to frighten and disperse birds B and/or other animals in the area. This two stage operation provides superior animal dispersal results in comparison to single cartridge launches, as the sound emitting rocket cartridge not only serves to scare animals from the vicinity of the launch site and downrange therefrom, but also transports the explosive charge much farther from the launch site to produce wider ranging dispersal results than are possible when the explosive cartridge is launched by itself.

FIGS. 2 and 3 respectively provide a detailed exploded perspective view and side elevation view in section of the present two stage pyrotechnic assembly 10. The pyrotechnic device 10 utilizes a first cartridge 12 which acts as a small, short duration rocket to propel a second cartridge 14 downrange away from the launch site for greater effectiveness. The first cartridge 12 may be a 15 mm diameter "Screamer Siren" type device, as manufactured by ABA Pyrotechnik GMBH of Marlenmunster, Germany. The second cartridge 14 is an explosive device having a relatively short duration fuse, lasting only long enough to allow the explosion to occur at some distance (e.g., thirty to fifty yards) from the launcher L, when fired as a single pyrotechnic device. ABA Pyrotechnik GMBH also manufactures such a device, known as the "Bird Banger" cartridge. Both of these cartridges 12 and 14 have essentially identical diameters 16 of about 15 mm, and fit within the bore of the launcher L.

The elongate "Screamer Siren" rocket cartridge 12 includes an essentially hollow rearward end 18, a medial portion 20, and a forward end 22 containing the propellant charge 24 therefor (shown most clearly in the sectional view of FIG. 3). The entire cartridge 12 is sufficiently small so that the rearward end 18 fits within the muzzle M of the handheld launcher L, generally as shown in the alternative embodiment of FIG. 5. The "Bird Banger" explosive cartridge 14 has the same diameter 16 as the rocket cartridge 12, but is shorter, having a forward end 26 and opposite rearward end 28. An explosive charge 30 is disposed within the cartridge 14.

Either of the two types of cartridges 12 or 14 may be fired conventionally from the launcher L, or other suitable type of launcher as desired. The limitations of the relatively short range for the single cartridges, particularly the explosive cartridge 14, have been noted above. This embodiment of the present invention, comprising the two stage assembly of a "Screamer" cartridge 12 and "Banger" cartridge 14, includes an external connector sleeve 32 which fits around the forward end 22 of the rocket or "Screamer" cartridge 12 and the rearward end 28 of the forwardly disposed explosive or "Banger" cartridge 14 to join the two cartridges 12 and 14 concentrically together as shown in FIGS. 2 and 3. The connector sleeve 32 includes a generally medially disposed internal cartridge separation disc 34, precluding excessive insertion of either cartridge 12 or 14 into the sleeve 32. The disc 34 includes a small explosive cartridge igniter passage 36 formed therethrough, to allow the last of the burning propellant from the rocket cartridge 12 to blow through the disc 34 and ignite the explosive charge 30 within the explosive "Banger" cartridge 14 at the end of the flight of the assembly.

The overall length of the assembly comprising the two concentric cartridges 12 and 14, is aerodynamically destabilizing, since the propellant charge 24 exits the rearward end 18 of the rocket cartridge 12 so far behind the center of mass of the combined assembly. Accordingly, some form of aerodynamic stabilizer is preferably included with the assembly in order to prevent the assembly from tumbling during its flight, thereby extending the range of the assembly as well. A first embodiment of the present pyrotechnic device 10 includes an aerodynamic stabilizer attachment bracket 38 having a rocket cartridge passage 40 formed therethrough, with the forward end portion 22 of the rocket cartridge 12 passing through and being affixed within (e.g., glued, etc.) the passage 40.

The stabilizer attachment bracket 38 further includes at least one (and preferably a pair of opposed) stabilizer attachment passage(s) 42 radially offset from and parallel to the rocket cartridge passage 40, with the forward end 44 of an elongate stabilizer stick 46 affixed within each stabilizer attachment passage 42. The stabilizer stick(s) 46 extend(s) rearwardly from each of the stabilizer attachment passages 42 parallel to the elongate axis of the rocket cartridge 12, with each stick 46 having a rearward end portion 48 disposed somewhat rearwardly of the rearward end portion 18 of the rocket cartridge 12. The radially offset disposition of the stabilizer attachment passage(s) 42 results in the stabilizer stick(s) 46 being radially spaced from the rocket cartridge 12, which permits the rearward portion 18 of the cartridge 12 to be inserted within the muzzle of the launcher L while the stabilizer stick(s) 46 extend rearwardly to the outside of the muzzle, avoiding interference between the stabilizer stick(s) 46 and the launcher L. The stabilizer sticks 46 create some rearward aerodynamic drag to keep the forward end 26 of the explosive cartridge 14 properly aimed and oriented, and also function to a lesser extent by providing some minor rearward shift of the center of mass of the assembly.

Figure 4:
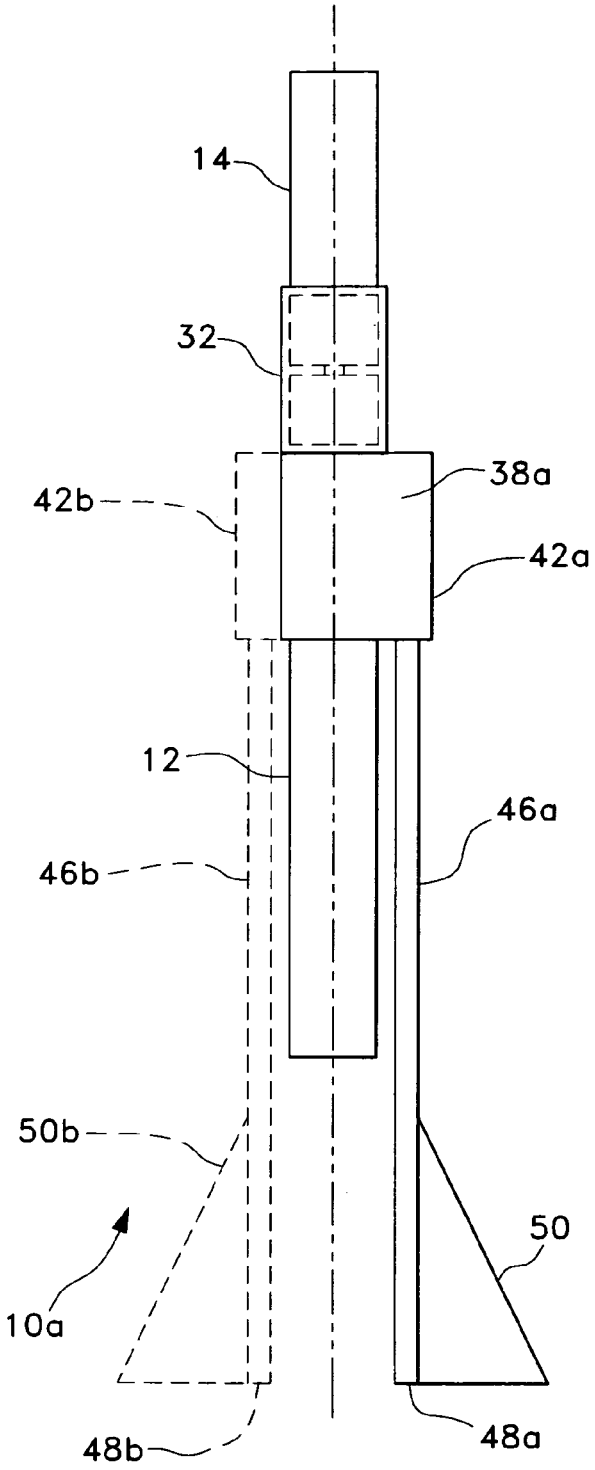
FIG. 4 is a side elevation view of an alternative embodiment of a pyrotechnic animal dispersal device of the present invention, showing an alternative in-flight stabilizer.

While two opposed stabilizer sticks 46 are illustrated in the embodiment 10 of FIGS. 2 and 3, the use of two laterally opposed stabilizers may not be required, depending upon the aerodynamics of the assembly, the thrust provided by the "Screamer Siren" rocket cartridge 12 or other booster cartridge, and perhaps other factors. Accordingly, FIG. 4 of the drawings provides an illustration of an alternative embodiment 10*a*, in which the stabilizer attachment bracket 38*a* has only a single stabilizer attachment passage 42*a* included therewith, with an optional opposite stabilizer attachment passage 42*b* shown in broken lines. A single stabilizer stick 46*a* extends rearwardly from the single stabilizer attachment passage 42*a*, with an optional second stick 46*b* disposed to the opposite side. Where only a single stick 46*a* is used, an aerodynamic stabilizing fin 50 may be provided, extending laterally from the rearward portion 48*a* of the stick 46*a*. A second such fin 50*b* may be applied to the opposite stick 46*b*, if such a second stabilizing stick 46*b* is used.

While the use of a single stabilizing stick 46*a* does produce some asymmetric drag, the predominant effect is to keep the rearward end 18 of the "Screamer Siren" rocket cartridge 12, and thus of the entire assembly 10*a*, oriented to the rear along the flight path of the device during its flight. A single stabilizer stick 46*a*, particularly when equipped with an aerodynamic fin 50, may be sufficient to accomplish this. The remainder of the assembly 10*a*, including the "Screamer Siren" rocket cartridge 12, explosive cartridge 14, and connector sleeve 32, is identical to the device 10 illustrated in FIGS. 2 and 3, with the exception of the stabilizer assembly.

Figure 5:
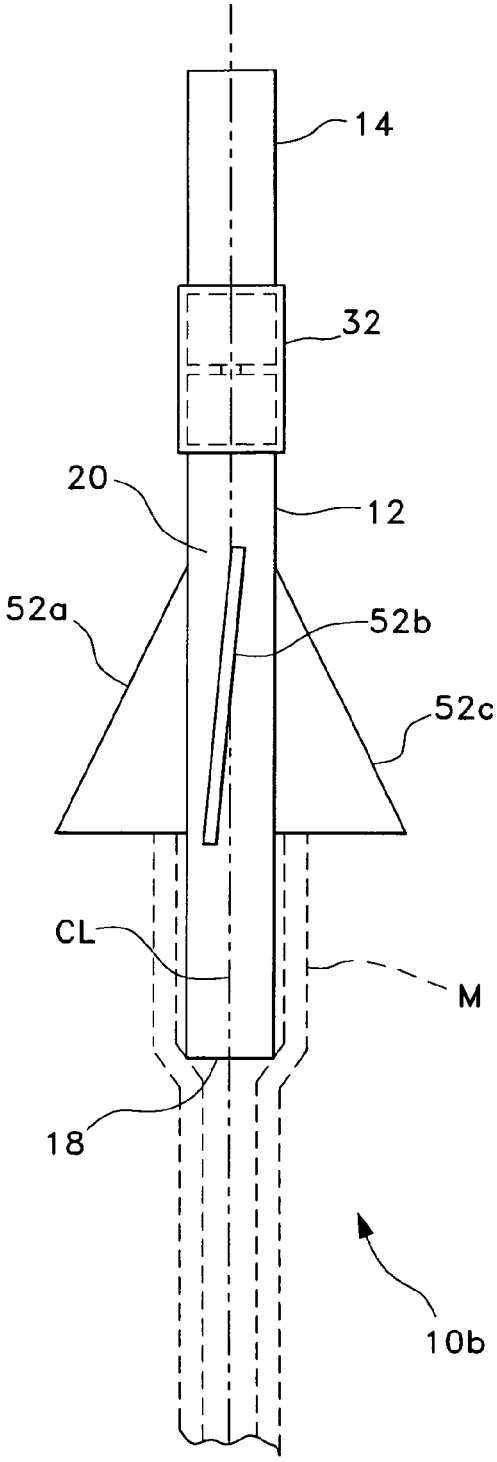
FIG. 5 is a side elevation view of another alternative embodiment of a pyrotechnic animal dispersal device of the present invention, showing another in-flight stabilizer.

FIG. 5 provides a side elevation view of yet another embodiment of the present pyrotechnic device, differing from other embodiments in the form of the aerodynamic stabilizing means incorporated. In FIG. 5, the assembly 10*b* does not include any form of stabilizer attachment bracket or fitting thereon, but rather includes a series of aerodynamic fins 52*a*, 52*b*, 52*c*, etc. extending radially directly from the medial portion 20 of the "Screamer Siren" or other booster rocket cartridge 12. This embodiment avoids the additional expense of a specialized stabilizer stick attachment bracket, but substitutes a series of separate fins 52*a*, 52*b*, 52*c*, etc., which may require more labor (and therefore greater expense) in production than the incorporation of the stabilizer stick attachment bracket and stick(s) of the embodiments of FIGS. 2 through 4. However, any of the various embodiments of the present invention may be used as desired.

It should be noted that the series of stabilizing fins 52*a*, 52*b*, 52*c*, etc. are disposed generally about the medial portion 20 of the rocket cartridge 12, in order to avoid interference with the muzzle M of the launcher when the rearward end portion 18 of the rocket cartridge 12 is inserted therein. All of the various stabilizing systems incorporated with the present invention, allow for the insertion of the rearward end portion 18 of the rocket cartridge 12 into the muzzle M of the launcher, in order to achieve proper ignition and launch of the assembly. It will also be noted that the fins 52*a*, 52*b*, 52*c*, etc. of the pyrotechnic device 10*b* of FIG. 5 are angularly offset relative to the centerline CL of the assembly, as indicated by the central fin 52*b*. This angular offset results in the assembly spinning about its centerline CL as it travels through the air, thereby providing gyroscopic stability for the assembly in somewhat the same manner as that achieved by the spin imparted to a rifle bullet by the spiral rifling within the barrel of the firearm. Such angular offset of the fins may also be incorporated in the embodiment 10*a* of FIG. 4, if so desired.

In conclusion, the present pyrotechnic animal dispersal device in its various embodiments, provides a much-needed improvement in such relatively small, hand launched devices. The inclusion of an explosive cartridge at the forward end of the "Screamer Siren" rocket cartridge, serves to transport the explosive device farther from the launch site and closer to the animals to be dispersed. While the additional mass of the explosive cartridge reduces the performance and range of the rocket cartridge, the addition of aerodynamic stabilizing devices on the rocket cartridge results in a more stable flight path which regains most, if not all, of any loss of efficiency caused by the carriage of the second stage explosive charge.

The present invention lends itself well to use with 15 mm diameter "Screamer Siren" and "Bird Banger" cartridges produced by ABA Pyrotechnik GMBH of Germany. The use of cartridges having identical diameters allows the use of a connector sleeve having a very clean configuration, and incorporating a passage allowing the rocket cartridge to ignite the explosive cartridge near the end of the flight of the assembly. However, the present multi-stage pyrotechnic animal dispersal device may be incorporated with other cartridges from other manufacturers and having somewhat different configurations, if so desired. In any event, the present animal dispersal device greatly improves the ability of the user to place most of the noise used to disperse the birds or other animals, closer to the location of the animals for greater effect. Accordingly, the present animal dispersal device in its various embodiments will be much appreciated by farmers, airport managers, and others who have need to disperse birds and/or other animals from open areas from time to time.

It is to be understood that the present invention is not limited to the embodiments described above, but encompasses any and all embodiments within the scope of the following claims.

I claim:

1. A pyrotechnic animal dispersal device, comprising:

a small, elongate, hand launcher deployed, sound emitting rocket cartridge having at least a diameter, a forward portion with a forward end, a medial portion, and a rearward end opposite the forward end;

a small, hand launcher deployed, explosive cartridge having at least a diameter identical to the diameter of said rocket cartridge, a forward end, and a rearward end opposite the forward end;

an externally disposed connector sleeve concentrically joining the forward end of said rocket cartridge to the rearward end of said explosive cartridge;

at least one aerodynamic stabilizer device extending from said rocket cartridge;

an aerodynamic stabilizer attachment bracket having a rocket cartridge passage formed therethrough and at least one radially offset stabilizer attachment passage formed therethrough parallel to the rocket cartridge passage, the forward portion of said rocket cartridge being affixed within the rocket cartridge passage of said aerodynamic stabilizer attachment bracket; and at least one aerodynamic stabilizer extending rearwardly from the at least one stabilizer attachment passage of said aerodynamic stabilizer attachment bracket and spaced apart from said rocket cartridge.

2. The pyrotechnic animal dispersal device according to claim 1, wherein said at least one aerodynamic stabilizer comprises an elongate stick disposed substantially parallel to said rocket cartridge, the stick having a rearward portion extending rearwardly beyond the rearward end of said rocket cartridge.

3. The pyrotechnic animal dispersal device according to claim 2, wherein the rearward portion of the elongate stick further includes an aerodynamic fin extending laterally therefrom.

4. The pyrotechnic animal dispersal device according to claim 1, wherein said at least one aerodynamic stabilizer device comprises a plurality of angularly offset fins extending radially from the medial portion of said rocket cartridge.

5. The pyrotechnic animal dispersal device according to claim 1, wherein said connector sleeve further includes an internal cartridge separation disc extending thereacross, the cartridge separation disc having an explosive cartridge igniter passage formed therethrough.

6. A pyrotechnic animal dispersal device and launcher therefor, comprising in combination:

a small, elongate, hand launcher deployed, sound emitting rocket cartridge having at least a diameter, a forward portion with a forward end, a medial portion, and a rearward end opposite the forward end;

a small, hand launcher deployed, explosive cartridge having at least a diameter identical to the diameter of said rocket cartridge, a forward end, and a rearward end opposite the forward end;

an externally disposed connector sleeve concentrically joining the forward end of said rocket cartridge to the rearward end of said explosive cartridge;

at least one aerodynamic stabilizer device extending from said rocket cartridge;

an aerodynamic stabilizer attachment bracket having a rocket cartridge passage formed therethrough and at least one radially offset stabilizer attachment passage formed therethrough parallel to the rocket cartridge passage, the forward portion of said rocket cartridge being affixed within the rocket cartridge passage of said aerodynamic stabilizer attachment bracket;

at least one aerodynamic stabilizer extending rearwardly from the at least one stabilizer attachment passage of said aerodynamic stabilizer attachment bracket and spaced apart from said rocket cartridge; and a handheld launcher having a muzzle accepting the rearward end of said rocket cartridge therein for launching.

7. The pyrotechnic animal dispersal device and launcher combination according to claim 6, wherein said at least one aerodynamic stabilizer comprises an elongate stick disposed substantially parallel to said rocket cartridge, the stick having a rearward portion extending rearwardly beyond the rearward end of said rocket cartridge.

8. The pyrotechnic animal dispersal device and launcher combination according to claim 7, wherein the rearward portion of the elongate stick further includes an aerodynamic fin extending laterally therefrom.

9. The pyrotechnic animal dispersal device and launcher combination according to claim 6, wherein said at least one aerodynamic stabilizer device comprises a plurality of angularly offset fins extending radially from the medial portion of said rocket cartridge.

10. The pyrotechnic animal dispersal device and launcher combination according to claim 6, wherein said connector sleeve further includes an internal cartridge separation disc extending thereacross, the cartridge separation disc having an explosive cartridge igniter passage formed therethrough.

11. The pyrotechnic animal dispersal device and launcher combination according to claim 6, wherein said launcher has a single shot pistol configuration.

12. The pyrotechnic animal dispersal device and launcher combination according to claim 6, wherein said launcher has a double shot pistol configuration.

* * * * *